US006361353B1

(12) United States Patent
Saka et al.

(10) Patent No.: US 6,361,353 B1
(45) Date of Patent: Mar. 26, 2002

(54) PRESSURE CONTACT CONNECTOR

(75) Inventors: Yukinori Saka; Masamitsu Chishima, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/569,868

(22) Filed: May 12, 2000

(30) Foreign Application Priority Data

May 14, 1999 (JP) ..... 11-134711

(51) Int. Cl.[7] ..... H01R 11/20; H01R 4/24; H01R 4/26; H01R 13/52

(52) U.S. Cl. ..... 439/405; 439/521

(58) Field of Search ..... 439/404, 405, 439/417, 409, 367, 519, 521

(56) References Cited

U.S. PATENT DOCUMENTS 3,865,460 A * 2/1975 Cherney et al. ..... 339/98
4,420,211 A * 12/1983 Ledbetter ..... 339/98
4,533,201 A * 8/1985 Wasserlein, Jr. ..... 339/99
4,954,098 A * 9/1990 Hollingsworth et al. .... 439/404
4,964,811 A * 10/1990 Hayes, Sr. et al. ..... 439/398
5,403,200 A * 4/1995 Chen ..... 439/404
5,417,583 A * 5/1995 Ishizaki et al. ..... 439/409
5,433,625 A 7/1995 Tsuji et al.
5,709,566 A 1/1998 Tsuji et al.
5,746,610 A * 5/1998 Shiu ..... 439/98
5,820,404 A * 10/1998 Chishisma et al. ..... 439/417
5,911,594 A * 6/1999 Baker, III et al. ..... 439/404
5,934,912 A * 8/1999 Morrell ..... 439/49
5,971,792 A * 10/1999 Lin ..... 439/404
6,027,362 A * 2/2000 LaCroix ..... 439/404
6,080,006 A * 6/2000 Broder ..... 439/409
6,111,201 A * 8/2000 Drane et al. ..... 174/92
6,135,821 A * 10/2000 Liu ..... 439/676
6,280,231 B1 * 8/2001 Nicholls ..... 439/402

* cited by examiner

*Primary Examiner*—P. Austin Bradley
*Assistant Examiner*—Edwin A. León
(74) *Attorney, Agent, or Firm*—Banner & Witcoff, Ltd.

(57) ABSTRACT

A plurality of electric wires 25 are distributed in an aligned manner on a distribution face 13 of a housing 10, a longitudinal direction of distribution thereof being at approximately right angles to a direction of attachment of insulation displacement terminal fittings 30. A cover 40 is attached from above. Walls 43 are provided on the cover 40 at locations which partition the spaces between distribution paths of the adjacent electric wires 25 and which also pass either side of the terminal fittings 30. The walls 43 permit incorrect attachment to be detected by interference. Front and rear walls 45F,45R are of different height to ensure correct orientation of the cover 40.

12 Claims, 5 Drawing Sheets

PRESSURE CONTACT CONNECTOR

TECHNICAL FIELD

The present invention relates to an electrical pressure contact connector.

BACKGROUND TO THE INVENTION

A conventional pressure contact connector is shown in JP-6-203643. This connector has a configuration whereby a housing is provided with a distribution face for electric wires, a plurality of terminal fittings are attached along this distribution face, and the electric wires are attached from above, by pressure contact, to a pressure contact member formed on each terminal fitting. The electric wires are insulated. Each pressure contact member formed on the terminal fittings is provided at one of a plurality of pressure contact locations on the distribution face, these pressure contact locations being provided on mutually differing locations of the terminal fittings. The plurality of electric wires for attachment by pressure contact are distributed along the distribution face at right angles to the direction in which the terminal fittings are attached to the housing.

The pressure contact connector described above, wherein the direction of attachment of the terminal fittings and the direction of distribution of the electric wires are at right angles, has the problem that if the direction of attachment of the terminal fittings is incorrect, the locations of the pressure contact members also become misaligned. As a result, the electric wires which have been attached by pressure contact to the incorrectly attached terminal fittings interfere with neighbouring electric wires and neighbouring pressure contact members, and there is the possibility that the pressure contact assembly cannot be performed.

The present invention has been developed after taking the above problem into consideration, and aims to present a pressure contact connector in which, in the case where the direction of attachment of the terminal fittings relative to the housing is at approximate right angles to the direction of distribution of the electric wires, incorrect attachment of the terminal fittings can be detected.

SUMMARY OF THE INVENTION

According to the invention there is provided an electrical connector having a housing, a plurality of elongate electrical terminal fittings distributed in the housing in an attachment direction, each terminal fitting having an insulation displacement terminal for attachment to an electrical wire, the terminals being provided in parallel locations, and at right angles to said attachment direction whereby parallel electrical wires can be attached thereto, the connector further including a cover for said terminals, the inner face of said cover having depending walls adapted to provide channels for said wires.

Preferably the walls are substantially continuous and parallel, and the terminals preferably project therebetween. The channels between the walls may define recesses to receive and locate tips of said terminals.

The outermost walls may have different heights to fit closely with corresponding surfaces of the housing, thereby to ensure correct orientation of the cover. The innermost depending walls may be of the same height.

A resilient latch may be provided between cover and housing, and the cover may have end walls extending in the fitting direction and engageable over the sides of the housing. These sides may have projections engageable in slots of the cover to prevent fore and aft movement in the fitting direction. The cover is preferably attached in a direction perpendicular to the fitting direction.

BRIEF DESCRIPTION OF THE DRAWINGS

Others features of the invention will be apparent from the following description of a preferred embodiment shown by way of example only in the accompanying drawings in which.

DESCRIPTION OF PREFERRED EMBODIMENT

Figure 1:
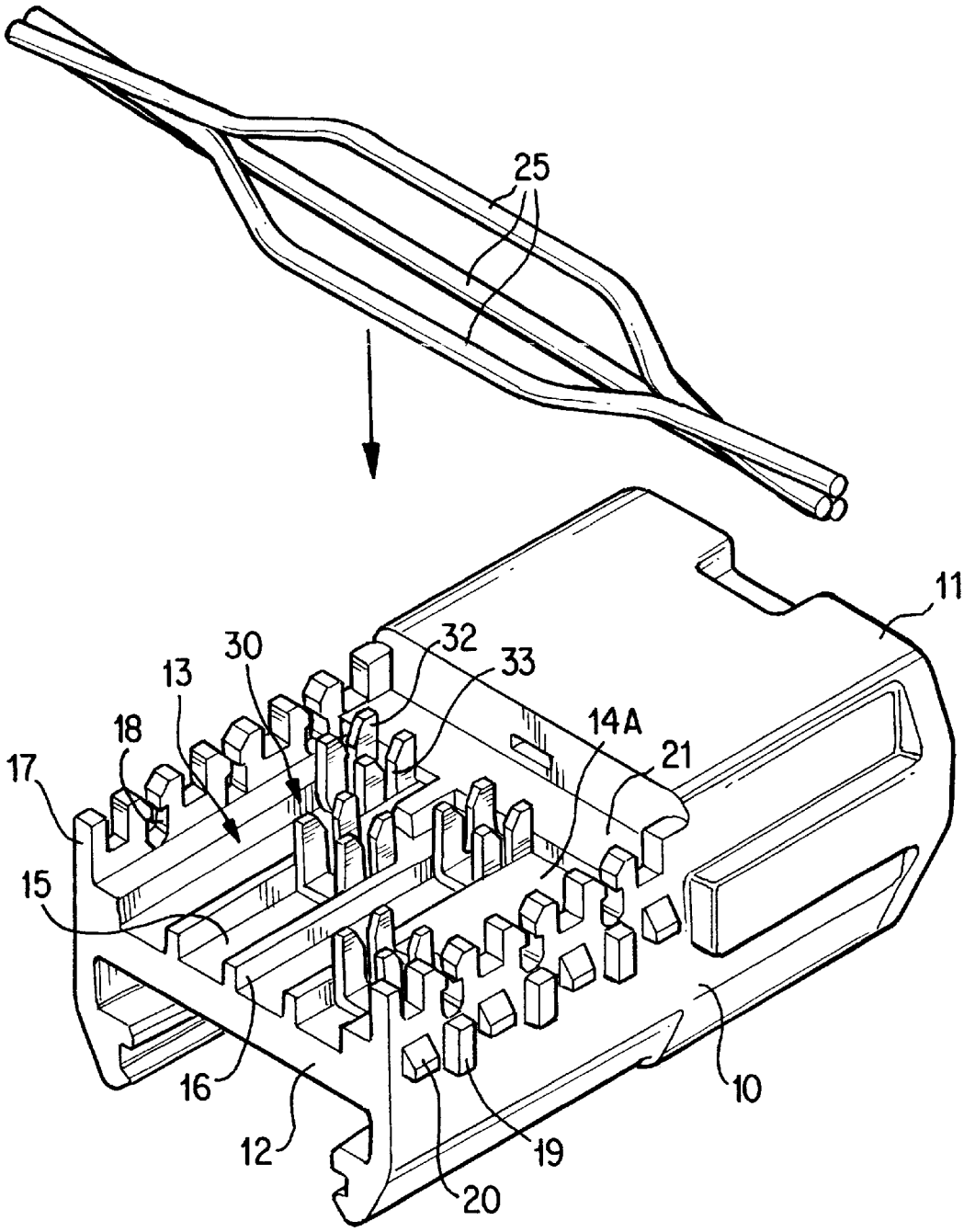
FIG. 1 is a diagonal view showing pressure contact terminal fittings in an attached state within a housing.
Figure 2:
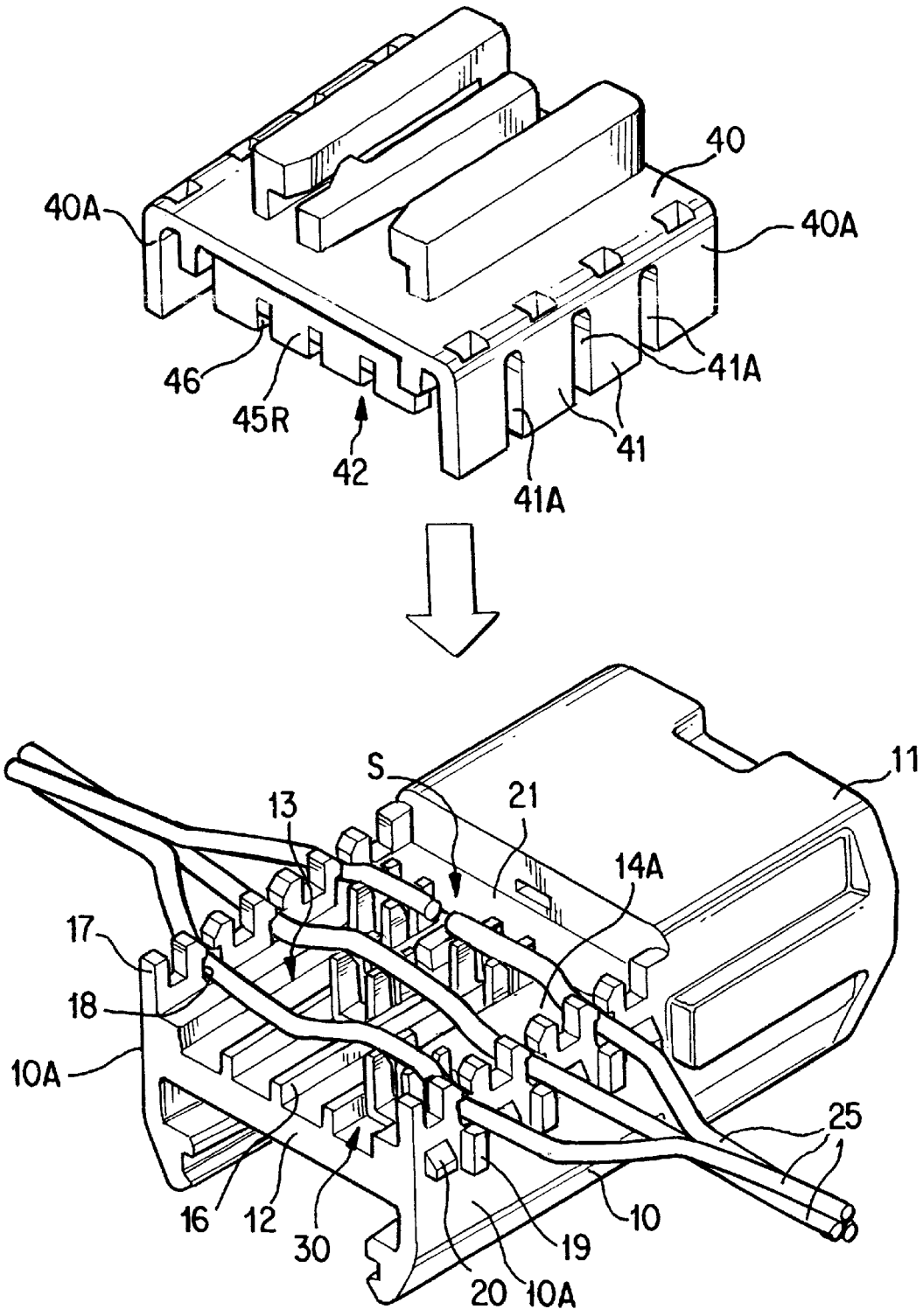
FIG. 2 is a diagonal view showing electric wires in a set state within pressure contact blades.
Figure 3:
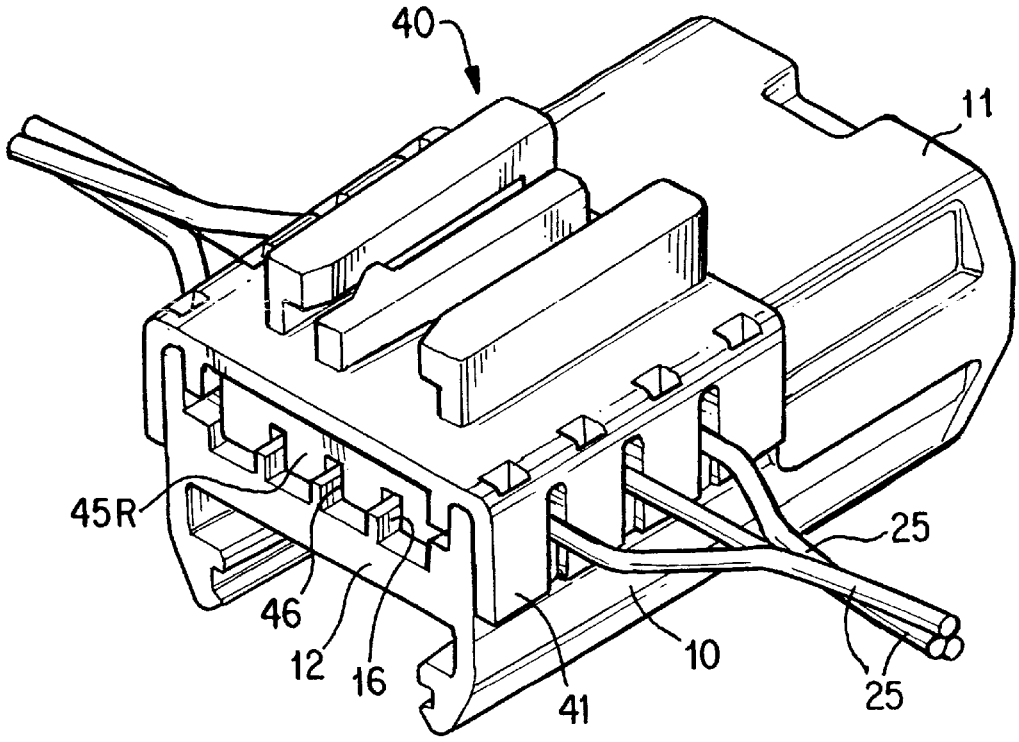
FIG. 3 is a diagonal viewing showing a cover in an attached state.

Next an embodiment of the present invention will be explained with the aid of FIGS. 1 to 7.

A pressure contact connector of the present embodiment comprises a housing 10, a plurality of pressure contact terminal fittings 30, and a cover 40. The housing 10 has a hood member 11 open to the anterior (to the upper right in FIGS. 1 to 3), and a distributing member 12, this distributing member 12 extending from a posterior end wall of the hood member 11 and having a plate-like shape. An upper face of the distributing member 12 is a distribution face 13. A plurality of pressure contact terminal fittings 30 (four in the present embodiment) are provided on this distribution face 13, and a plurality of electric wires 25 (three in the present embodiment), attached by pressure contact to the pressure contact terminal fittings 30, are distributed along the distribution face 13. The distributed electric wires 25 extend to left and right sides from the distribution face 13.

The distribution face 13 will now be explained in detail. A plurality of attachment holes 14 (four in the present embodiment) are formed on the distribution face 13. The attachment holes 14 extend in an anterior-posterior direction, the pressure contact terminal fittings 30 being inserted therein. Each attachment hole 14 forms a square face cross-sectionally, an anterior end thereof passing through the posterior end wall of the hood member 11 and opening into the hood member 11. A ceiling face of the housing 10 is cut away for a prescribed distance from the posterior end thereof, this forming an open channel 15 at a posterior end side of each attachment hole 14. The open length of the channels 15 in an anterior-posterior direction varies in each attachment hole 14. The channel at the right in FIG. 1 is shortest in length. The second and fourth channels counting from the right in FIG. 1, are identical in length, and are the longest. The channel third from the right is intermediate in length.

Figure 4:
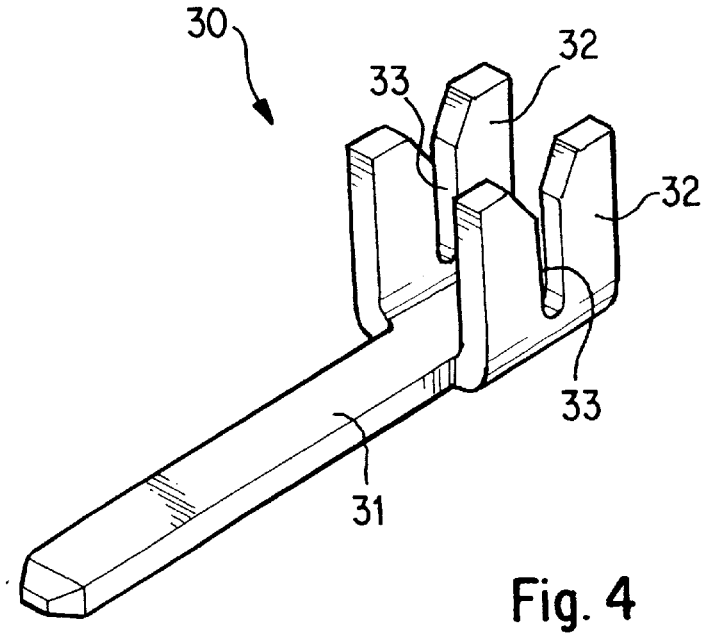
FIG. 4 is a diagonal view of the pressure contact terminal fittings.

The pressure contact terminal fittings 30 comprise electrically conductive sheet metal which has been punched out in a specified shape and then bent. As shown in FIG. 4, each pressure contact terminal fitting 30 comprises a strip-like tab 31 which extends for a specified length in an anterior-posterior direction, and a pair of blades 32 which protrude upwards from left and right side edges at a posterior end of the tab 31.

Pressure contact blades 33 are formed in each of the blades 32. These pressure contact blades 33 are open in an upwards direction. The electric wires 25 are attached therein by pressure contact and insulation displacement. The pressure contact terminal fittings 30 are attached to the housing 10 by inserting the tabs 31 thereof into the attachment holes 14 of the housing 10 from a posterior direction. When these pressure contact terminal fittings 30 are in an attached state, the pressure contact blades are adjacent the open lengths of the members 15 and are fixed in position in an anterior-posterior direction.

Each pressure contact blade is provided, in this fixed state, in one of a plurality of pressure contact locations which are at right angles to the direction of attachment of the terminal fittings. The position of each pressure contact blade 33 depends on the location of the respective channel. The pressure contact blades 33 protrude upwards at a location higher than dividing walls 16 which separate the open members 15. As a result, the electric wires 15 attached by pressure contact to the pressure contact blades 33 do not interfere with the dividing walls 16. Moreover, the tabs 31 of the pressure contact terminal fittings 30 are not uniform in length. In the case of the pressure contact terminal fittings 30 attached to the attachment holes 14 with the longest open members 15, the tabs 31 are short. The pressure contact terminal fitting 30 attached to the attachment hole 14 with the shortest open member 15 has a long tab 31. As a result. anterior ends of these tabs 31 are aligned so that all protrude the same distance into the hood member 11.

Electric wire supporting walls 17 are formed at left and right sides (10A) of the distribution face 13. A plurality of electric wire supporting grooves 18 (three in the present embodiment) are formed in each electric wire supporting wall 17. These grooves 18 are provided in an anterior-posterior direction, are separated by spaces, and align with the pressure contact blades 33 when the position of these pressure contact blades 33 has been fixed (viewed from the side, the grooves 18 and the pressure contact blades 33 coincide). Guiding ribs 19 are formed on outer faces of the walls 17. When the cover 40 is attached, these guiding ribs 19 fix the position thereof in an anterior-posterior direction. Furthermore, latching protrusions 20 are formed on the outer face of the electric wire supporting walls 17 to prevent the removal of the cover 40 after it has been attached.

An anterior end portion of the distribution face 13 is higher than a ceiling plate 14A forming part of the attachment hole 14. This higher face forms a regulating face 21. A posterior side of the cover 40 is provided with a dust-proof wall 45R which functions as a regulating member thereof. The regulating face 21 works in conjunction with the dust-proof wall 45R to prevent the cover 40 from being attached to the housing 10 in an incorrect direction.

The cover 40 has a thick sheet-like shape in its entirety and is attached to the housing 10 so as to cover the entire distribution face 13. The fitting direction thereof is as follows: when the distribution face 13 is in an upward-facing state, the cover 40 is lowered thereupon from a position directly above the distribution face 13. In other words, the fitting direction of the cover 40 is at right angles to the plane of the distribution face 13. Latching members 41 are formed at left and right sides (40) of the cover 40. These latching members 41 move resiliently outwards and engage with the latching protrusions 20 of the housing 10 and thereby latch the cover 40 to the housing 40. A plurality of openings, separated by slots (41 A) are provided in an anterior-posterior direction in the members 41, thereby preventing these members 41 from interfering with the guiding ribs 19. When the cover 40 and the housing 10 are attached, the slots (41A) between the members 41 fit with the guiding ribs 19, thereby fixing in an anterior-posterior direction the position of the cover 40 relative to the housing 10. Furthermore, the latching members 41 fit tightly with left and right outer side faces of the housing 10, thereby fixing in a left-right direction the position of the cover 40 relative to the housing 10.

Figure 5:
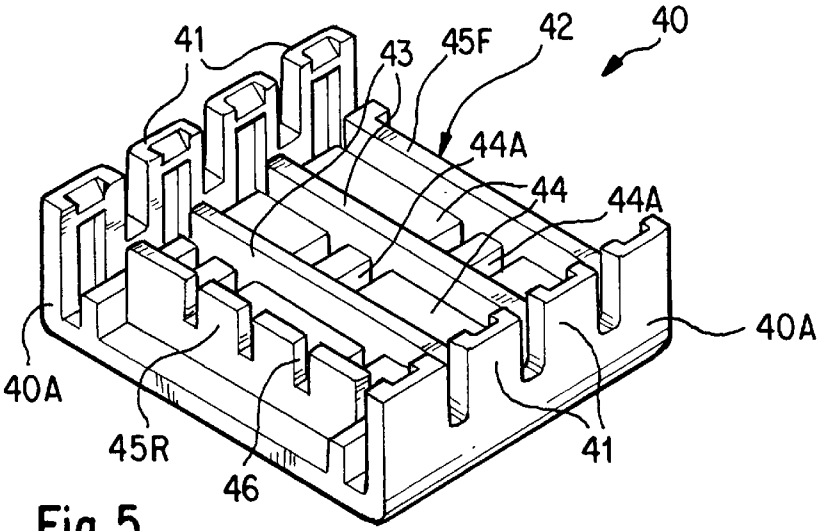
FIG. 5 is a diagonal view of the cover in an upside-down state.

When the cover 42 is in an assembled state with the housing 10, the lower face 42 opposes the distribution face 13. As shown in FIG. 5, a plurality of long thin walls 43 (two in the present embodiment) extend within the lower face 42 in the direction of the electric wires 25, spaces being provided therebetween at the anterior and posterior thereof. These walls 43 separate the electric wires 25 distributed along the distribution face 13. The pressure contact blades 33 are adjacent to the walls 43 in an anterior-posterier direction, the walls 43 being located between these pressure contact blades 33. As a result, when the cover 40 is facing the correct direction when it is to be attached to the housing 10, the walls 43 and the pressure contact blades 33 do not mutually interfere. Furthermore, the walls 43 have a depth such that, when the cover 40 has been attached, they either make contact with upper side faces of the dividing walls 16 between the open members 15 or, alternatively, leave an extremely small space therebetween, this space being much smaller than an outer diameter of the electric wires 25.

Pressing members 44 are formed on the lower face of the cover 40, these extending along the electric wires 25 distributed along the distribution face 13. Grooves 44A are formed in these pressing members 44, thereby preventing the pressing members 44 from interfering with upper edge portions of the pressure contact blades 33. Portions of these pressing members 44 press on the electric wires 25 between the pairs of pressure contact blades 33, thereby causing the electric wires 25 to make pressure contact with the contact blades 33. Other portions of the pressing members 44 press the portions of the electric wires 25 that are to the exterior of the pressure contact blades 33, thereby preventing the electric wires 25 from rising upwards.

Dustproof walls 45F and 45R are located at the anterior side edge of the posterior side edge, respectively, of the lower face of the cover 40. These dustproof walls 45F and 45R extend in a left-right direction (the direction of distribution of the electric wires 25) and serve to prevent foreign objects from entering the distribution face 13. When the cover 40 has been attached facing the correct direction, a lower end face of the anterior dustproof wall 45F makes contact with the regulating face 21, or a very slight gap is left between the dustproof wall 45F and the regulating face 21. The posterior dustproof wall 45R makes contact with a floor face (21A) of the channels 15 or, alternatively, a very slight gap is left therebetween. Grooves 46 are formed in the posterior dustproof wall 45R in order to prevent the dividing walls 16 from interfering therewith. The regulating face 21 of the housing 10 is higher than the channels 15 (from the floor faces thereof). As a result, a lower side face of the anterior dustproof wall 45F is located at a higher position than a lower side face of the posterior dustproof wall 45R. Consequently, the lower side face of the posterior dustproof wall 45R will strike against the regulating face 21 if the cover 40 is being attached back-to-front, and the attaching operation (the operation of attaching the cover 40 to the housing 10) will be halted. That is, the posterior dustproof wall 45R functions as a position regulating member of the present invention.

Next, the operation of the present embodiment will be explained.

The order of assembly of the pressure contact connector is as follows. First, the pressure contact terminal fittings 30 are attached to the housing 10 (see FIG. 1), the three electric wires 25 are fixed thereto from above, and the electric wire 25 located at the position farthest to the anterior is severed at a location (S in FIG. 2) between two pressure contact blades 33 of two mutually adjacent pressure contact terminal fittings 30. Next, the cover 40 is attached to the housing 10. At this juncture, the locking members 41 make sliding contact with left and right outer faces of the housing 10 and fit with the guiding ribs 19, thereby fixing the position of the cover 40 in an anterior-posterior direction and a left-right direction. The cover 40 is attached in a horizontal state to the housing 10, and the members 41 and the protrusions 20 fit together, thereby latching the cover 40 to the housing 10 (see FIG. 3 and FIG. 6).

While the cover 40 is being attached, the pressing members 44 press the electric wires 25 downwards, thereby causing them to make pressure contact with the pressure contact blades 33. This pressure contact cuts into plastic insulation of the electric wires 25 and exposed core wires thereof make contact with inner side edges of the pressure contact blades 33. Further, the portions of the electric wires 25 that are outside the pressure contact blades 33 are pressed downwards by the pressing members 44. The movement of the electric wires 25 is thereby regulated.

Figure 6:
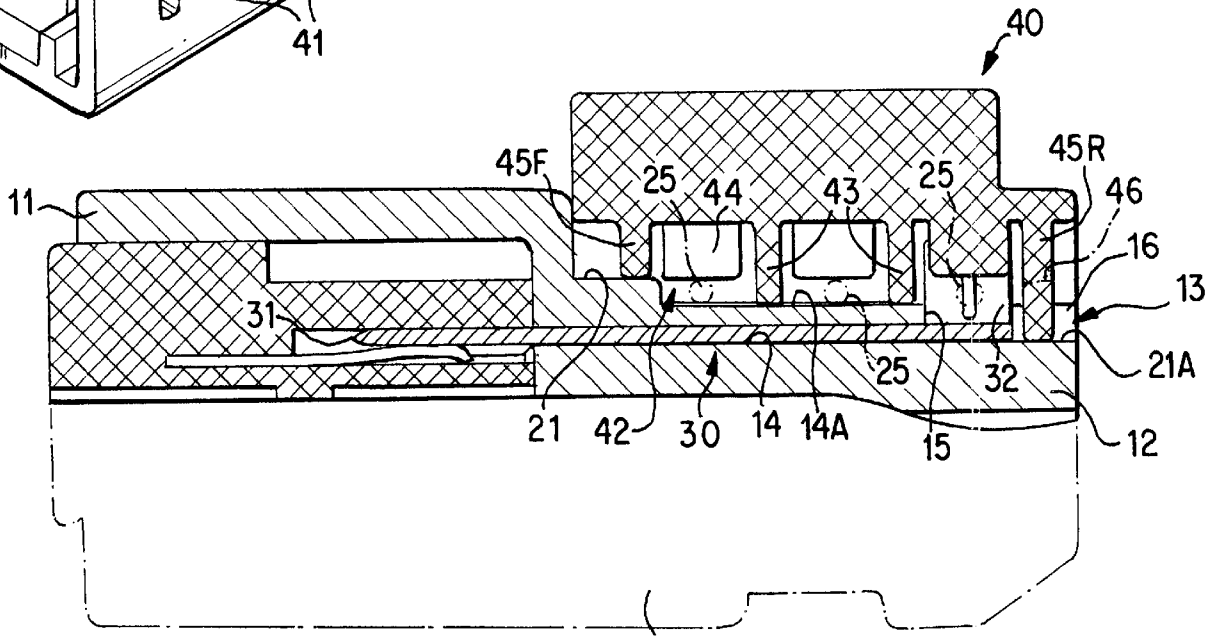
FIG. 6 is a cross-sectional view of the cover attached in a correct direction.

When the cover 40 is in an attached state, as shown in FIG. 6, the walls 43 of the cover 40 are located so as to form partitions between the distribution paths of the three electric wires 25. Consequently, the pressure contact blades 33 located in the neighbouring distribution paths are also in an isolated state. As a result, even if foreign objects penetrate between the cover 40 and the distribution face 13 after attachment has been completed, those foreign objects are reliably prevented from short-circuiting the pressure contact blades 33. In the present embodiment, the dustproof walls 45F and 45R, in particular, are provided. These prevent foreign objects from penetrating inside the cover 40 and thereby reliably ensure that the pressure contact blades 33 are not short-circuited by foreign objects.

Figure 7:
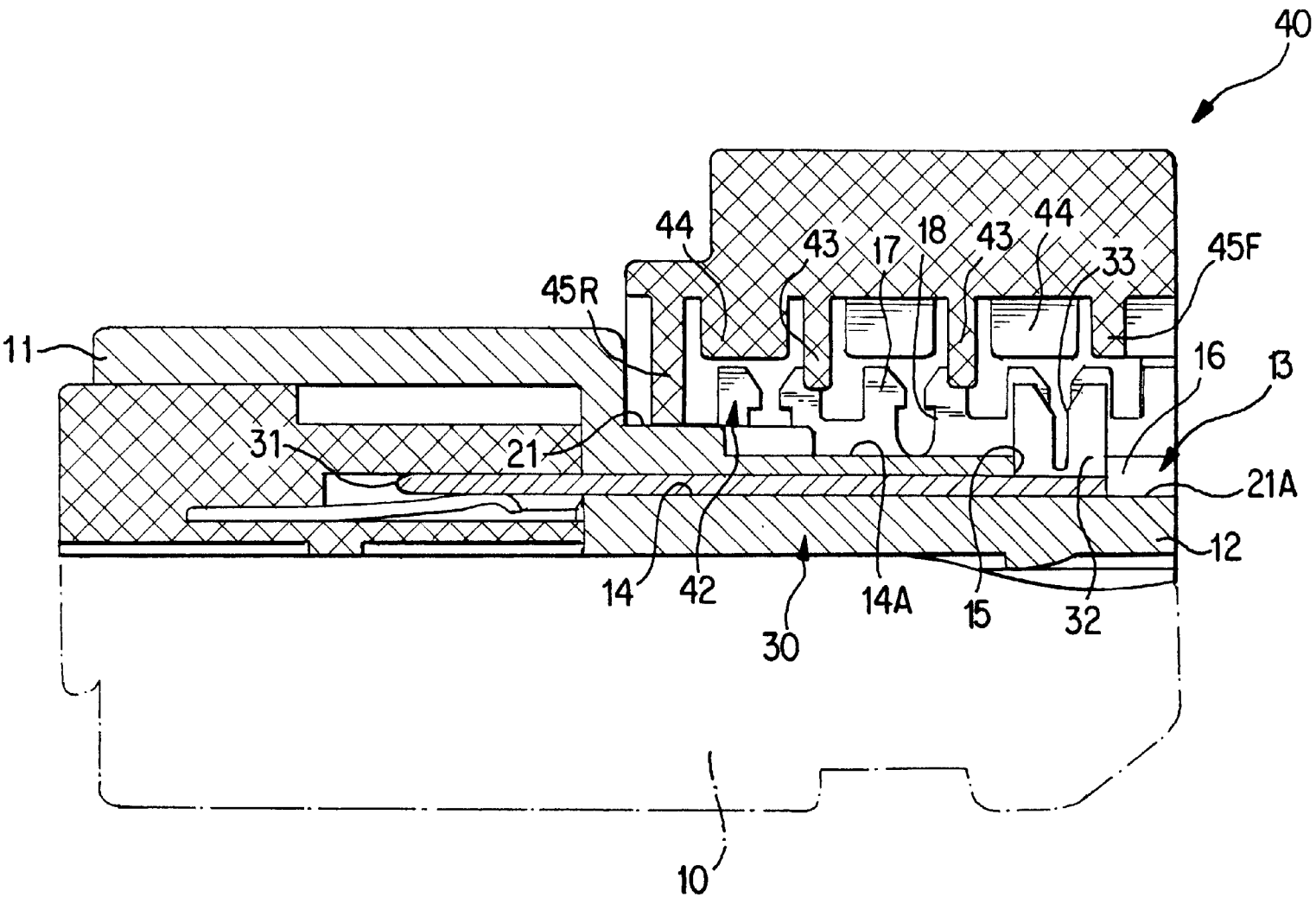
FIG. 7 is a cross-sectional view of the cover attached in an incorrect direction.

Further, if the cover 40 is attached back-to-front, as shown in FIG. 7, the posterior dustproof wall 45R strikes against the regulating face 21 of the housings 10, thereby halting the attaching operation. Accordingly, the walls 43 of the cover 40 and the pressure contact blades 33 of the housing 10 do not interfere with each other, and this prevents change of shape of the pressure contact blades 33 or the walls 43, and prevents the walls 43 from pressing excessively on the electric wires 25.

In the case where the pressure contact terminals 30 are incorrectly attached even though the attachment direction of the cover 40 is correct, the pressure contact blades 33 of the pressure contact terminals 30 enter the distribution area of the adjoining electric wires 25 and come to be located below the walls 43 or the dustproof walls 45F and 45R. In this case, the walls 43 or the dustproof walls 45F and 45R strike against the pressure contact blades 33 thereby preventing the attachment operation of the cover 40 from continuing. Consequently, the incorrect attachment of the pressure contact terminals 30 can be detected.

The present invention is not limited to the embodiments described above. For example, the possibilities described below also lie within the technical range of the present invention. In addition, the present invention may be embodied in various other ways without deviating from the scope thereof.

(1) In the present embodiment, only an example having male terminal fittings is explained. However, the present invention is also suitable for female terminal fittings.

(2) In the present embodiment, the regulating members are provided on the housing at two locations with the space therebetween extending along the direction of attachment of the terminal fittings. However, according to the present invention, the regulating members may be provided at two locations with the space therebetween extending along the direction of distribution of the electric wires.

(3) In the present embodiment, the regulating members are provided at peripheral edges of the distribution face. However, according to the present invention, the regulating members may be provided more towards the centre.

What is claimed is:

1. An electrical connector for connection with a plurality of wires, the connector comprising:

a housing;

a plurality of elongate terminal fittings disposed substantially in parallel in said housing, wherein each said terminal fitting includes an insulation displacement terminal constructed and arranged for electrical connection with a respective wire extending in A direction substantially perpendicular to said plurality of terminal fittings; and a cover having an inner face from which a plurality of channel walls extends said walls defining a respective channel for each electrical wire;

wherein each said terminal projects into a respective said channel defined between said channel walls.

2. A connector according to claim 1 wherein said plurality of channel walls are substantially parallel and continuous.

3. A connector according to claim 1 wherein each said channel defined between said channel walls includes a recess located to receive a tip of said terminals.

4. A connector according to claim 1 wherein said plurality of channel walls comprises inner and outer channel walls, said inner channel walls having substantially the same height.

5. A connector according to claim 1 wherein each said terminal projects into a respective said channel defined between said channel walls.

6. A connector according to claim 5 wherein each said channel defined between said walls includes a recess located to receive a tip of said terminals.

7. A connector according to claim 1 wherein the outermost channel walls of said plurality of channel walls have different heights, and said housing includes surfaces adapted to closely conform to said outermost channel walls.

8. A connector according to claim 7 and further including a latching mechanism for latching together said cover and housing, said latching mechanism being operable only with a correct orientation of said cover with respect to said housing.

9. An electrical connector in accordance with claim 1, said cover further including opposite end walls also extending from said cover and defining slots to guide wires into respective said channels, said end walls overlapping opposite sides of said housing.

10. A connector according to claim 9 wherein said opposite sides of said housing have projections, and said end walls have slots engageable with said projections to prevent relative movement of said cover.

11. A connector according to claim 10 wherein said slots are perpendicular to a direction in which said housing and said cover are engaged.

12. An electrical connector comprising:

a housing;

a plurality of elongate electrical terminal fittings, each having an elongate body, the bodies being parallel to each other in the housing so as to extend in a first direction, each terminal fitting further having a pair of insulation displacement blades at right angles to the bodies, the blades defining an opening therebetween, the blades being aligned in the first direction to receive a wire trough the opening in a direction perpendicular to the first direction; and a cover having an inner face that overlies the blades and includes depending walls that define channels for receiving the blades, the channels extending perpendicular to the first direction and receiving the wires such that one wire is received in each channel so as to be isolated from the other wires.

* * * * *

UNITED STATES PATENT AND TRADEMARK OFFICE

CERTIFICATE OF CORRECTION

PATENT NO. : 6,361,353 B1 
DATED : March 26, 2002
INVENTOR(S) : Yukinori Saka and Masamitsu Chishima It is certified that error appears in the above-identified patent and that said Letters Patent is hereby corrected as shown below:

Column 6,
Line 2, insert -- channel -- between "said walls".

Column 8,
Line 5, change "trough" to -- through --.

Signed and Sealed this

Eleventh Day of June, 2002

*Attest:*

*Attesting Officer*

JAMES E. ROGAN
*Director of the United States Patent and Trademark Office*